US007324746B2

(12) United States Patent
Tanaka et al.

(10) Patent No.: US 7,324,746 B2
(45) Date of Patent: Jan. 29, 2008

(54) FLUID HEATER AND EVALUATION EQUIPMENT INCORPORATING THE SAME

(75) Inventors: Hideki Tanaka, Kobe (JP); Kimio Yoshizumi, Tanba (JP); Hitoshi Ando, Kobe (JP); Akiko Kuse, Kawaguchi (JP)

(73) Assignee: Espec Corp., Osaka (JP)

( * ) Notice: Subject to any disclaimer, the term of this patent is extended or adjusted under 35 U.S.C. 154(b) by 0 days.

(21) Appl. No.: 11/288,500

(22) Filed: Nov. 29, 2005

(65) Prior Publication Data

US 2006/0120703 A1 Jun. 8, 2006

(30) Foreign Application Priority Data

Dec. 2, 2004 (JP) ..... 2004-349379

(51) Int. Cl.
*F24H 1/10* (2006.01)

(52) U.S. Cl. ..... 392/465; 392/480; 219/541

(58) Field of Classification Search ..... None
See application file for complete search history.

(56) References Cited

U.S. PATENT DOCUMENTS

2003/0029860 A1* 2/2003 Bullock et al. ..... 219/541

* cited by examiner

*Primary Examiner*—Thor S. Campbell
(74) *Attorney, Agent, or Firm*—Wood, Phillips, Katz, Clark & Mortimer

(57) ABSTRACT

A temperature regulator has two headers connected to both ends of a heat receiving tube in which gas flows. The heat receiving tube has a heating element at the outer periphery thereof and a mixer accommodated therein to cause turbulent flow of gas passing through the heat receiving tube. The headers each have fins radially attached thereto, thereby ensuring strength of the headers and improving heat exchange efficiency.

24 Claims, 7 Drawing Sheets

FLUID HEATER AND EVALUATION EQUIPMENT INCORPORATING THE SAME

BACKGROUND OF THE INVENTION

1. Field of the Invention

The present invention relates to a fluid heater and an evaluation equipment incorporating the fluid heater, and more particularly to a fluid heater adapted to precisely respond to changes in flow rate or target supply temperature of fluid and an evaluation equipment provided with the fluid heater.

2. Description of the Related Art

Recently, there is demand for supply of a fluid with conditions such as temperature or flow rate precisely regulated for a development test of a fuel cell, brought to attention as a power supply device to vehicles such as cars, in a biotechnology field, or of a drug. In order to meet the demand, for example, an evaluation equipment provided with a fluid supply means such as a gas supply unit for evaluation tests for a fuel cell as disclosed in the patent document 1 described below has been proposed.

Patent Document 1: JP 2004-273222A

The fluid supply means as disclosed in the patent document 1 evaluates the performance of a fuel cell at a supply temperature of fluid such as oxygen or hydrogen regulated into a desired temperature. Further, the fluid supply means as disclosed in the above-mentioned patent document 1 is employed so as to carry out an evaluation in a biotechnology field or for a development test of drugs, in which a fluid regulated into a desired temperature condition is supplied.

The above-mentioned conventional evaluation equipment has regulated fluid temperature by a heater such as a so-called sheathed heater being positioned within a duct for guiding fluid or a rubber heater wound around the outer periphery of a duct. In these structures, considerable changes of parameters such as fluid supply rate or fluid supply temperature has such problems as causing time lag before fluid heated to a desired temperature is supplied and unexpected failure such as unstable supply temperature of fluid. As a result, the conventional evaluation equipment has such problems that a heating capacity of a heater is not precisely regulated depending on fluid flow rate.

In a structure of a sheathed heater positioned within a duct for guiding fluid, the fluid comes in contact with the heater. Therefore, when combustible fluid or explosive gas such as hydrogen is heated, additional measures for protection against an ignition or an explosion should be taken, resulting in a problem that equipment components are made complicated.

In the case of a rubber heater, there is a problem that electric power cannot be supplied at a high-power density because it is necessary to take into account conditions such as heat resistance limitation of a rubber material wrapping the rubber heater. A structure of a rubber heater wound around a duct, therefore, causes a problem that heat transfer area must be ensured by taking measures to lengthen a duct in which fluid flows, for example. In the case of the rubber heater, there is also a problem that a rubber material on the surface of a duct for electrical insulation has a function of a heat insulating material, resulting in lowering heat transfer efficiency.

Evaluation equipments include the above-mentioned equipment for a fuel cell that requires continuous supply of fluid to an article to be evaluated in one direction, without circulating it. The evaluation equipment cannot take measure to get fluid back to a heater to reheat even if temperature of the fluid heated by means of the heater is far from a desired supply temperature. Therefore, the evaluation equipment with a fluid supply means as disclosed in the patent document 1 or a fluid heater employed therein do not smoothly address the changes in fluid supply temperature or in fluid supply rate. Consequently, an evaluation equipment such as the conventional fuel-cell evaluation equipment or a fluid heater employed therein has such a problem that an evaluation is not carried out with maintaining a high degree of accuracy because of unstable supply of fluid to a fuel cell to be evaluated in trying to carry out an operation test in a simulated state of a fuel cell employed under an environment with sharp load fluctuations or severe temperature fluctuations in use environment such as cars.

Further, in the above-mentioned conventional evaluation equipment, to make fluid supply be widely altered, it is necessarily to make a duct diameter of a fluid passageway large in preparation for supplying a high rate of fluid flow or to employ a heater with a large heating capacity to heat fluid flowing in a fluid passageway. As just described, in the equipment having the duct diameter of the fluid passageway or the heating capacity of the heater be made large, conditions such as fluid supply temperature are well controlled when fluid supply to an article to be evaluated such as a fuel cell is enough large in amount, but are not well controlled when fluid supply is relatively small, resulting in lowered accuracy of the evaluation test.

SUMMARY OF THE INVENTION

In view of the problems described above, an object of the present invention is to provide a fluid heater adapted to precisely respond to the changes in flow rate or target supply temperature of fluid, and an evaluation equipment provided with the fluid heater.

In order to solve the foregoing problems, therefore, an aspect of the present invention provided herein is a fluid heater including a header and a heat receiving tube having an outer periphery, the header and the heat receiving tube mutually communicating so that fluid flows therethrough, wherein the heat receiving tube has a heating element positioned on the outer periphery of the tube, and wherein the heating element comprises a heating layer adapted to generate heat by electric supply, an insulating layer insulating the heating layer and the heat receiving tube, and a covering layer covering the heating layer.

In the fluid heater in the present aspect, the heating element is positioned on the outer periphery of the heat receiving tube, not within the tube through which fluid flows. Thus, the fluid heater in the present aspect smoothly and evenly heats fluid flowing through the tube regardless of flow rate of the fluid. Consequently, the fluid heater in the present aspect precisely regulates fluid temperature even if flow rate or heating target temperature of fluid to be heated is altered.

In the fluid heater in the present aspect, the heating element is positioned on the outer periphery of the heat receiving tube, so that fluid flowing in the tube have no direct contact with the heating element. Thus, the fluid heater in the present aspect heats well gas mainly consisting of hydrogen or flammable fluid which should not have direct contact with the heating element.

Herein, the heater of the present invention is most preferably provided with a pair of the headers, but may be provided with one header.

Another aspect of the present invention provided herein is a fluid heater including a header and a plurality of heat receiving tubes, the header and each of the heat receiving tubes mutually communicating so that fluid flows therethrough, and being adapted to divide gas flowing through the header into the heat receiving tubes, wherein the heat receiving tubes each have a heating element positioned on the outer periphery of the tube and adapted to generate heat by electric supply.

In the fluid heater in the present aspect, the heating element is positioned on the outer periphery of the heat receiving tube. Further, in the fluid heater in the present aspect, a plurality of the tubes are connected to the header so as to divide fluid flowing through the header into each of the tubes and heat the fluid. Thus, the fluid heater in the present aspect smoothly and evenly heat fluid flowing through the tubes regardless of flow rate of the fluid. Consequently, the fluid heater in the present invention precisely regulates fluid temperature even if flow rate or heating target temperature of fluid to be heated varies.

In the fluid heater in the present aspect, the heating element is positioned on the outer periphery of the heat receiving tube, so that fluid flowing in the tube have no direct contact with the heating element. Thus, the fluid heater in the present aspect is suitably applicable for heating fluid which should not have direct contact with the heating element.

Herein, in the fluid heater in the above-mentioned aspects, the heating layer may be printed on the insulating layer.

According to this structure, the heating layer is easily formed on the insulating layer. Further, as the present aspect, printing to form the heating layer enables the heating layer to come in contact with the insulating layer without failure, thereby minimizing heat transfer resistance between the heating layer and the insulating layer.

Still further, a printing method to form the heating layer in the present aspect sets a form of the heating layer more freely compared with another method such as metal wiring wound around the outer periphery of the heat receiving tube.

Herein, in the fluid heater in the above-mentioned aspects, the heating layer may be composed of a plurality of heating parts mutually connected in parallel.

The fluid heater in the present aspect has the heating parts each being mutually connected in parallel. Thus, in the fluid heater in the present aspect, if the heating parts are unevenly heated from one part to another, electrical resistance of the heating part at a high-temperature part becomes higher than that at a low-temperature part, so that electrical current flows to the heating parts at the low-temperature part more than to the heating parts at the high-temperature part. In accordance with that, increased heat generation at the low-temperature part solves the above-mentioned uneven heating. Consequently, the fluid heater in the present aspect evenly heats fluid flowing through the heat receiving tube.

The fluid heater in the above-mentioned aspects may have such a structure that the heat receiving tube has a plurality of the heating elements or the heating layers mounted on the tube, each having electric resistance that varies with temperature and wherein the heating elements or the heating layers have different electric resistances depending on positions where the elements or the layers are mounted.

In this structure, even though the same amount of electric power is supplied to the heating layer, heat generation is different depending on positions where the heating elements or the heating layers are mounted. Thus, according to the above-mentioned structure, temperature distribution within the heat receiving tube is controlled from one part to another, thereby ensuring that fluid temperature is precisely regulated even with fluctuations in conditions such as flow rate of fluid flowing through the tube.

Herein, there is such a possibility that fluid flowing through the heat receiving tube forms temperature gradient in a longitudinal direction of the tube resulting from heating in a substantially even heating condition in a direction of the fluid flow, resulting in generation of uneven heating of the fluid discharged from the fluid heater.

In view of the problem described above, it is possible that the fluid heater in the above-mentioned aspects has such a structure that the heat receiving tube has a plurality of the heating elements or the heating layers having different electric resistances, mounted on the tube and arranged in a direction of gas flow and that the heating layers have different electric resistances depending on positions where the heating layers are mounted on the tube.

This structure provides the fluid heater capable of regulating fluid temperature precisely regardless of fluctuations of conditions such as flow rate of the fluid.

The fluid heater in the above-mentioned aspects may have such a structure that the outer periphery of the heat receiving tube is evenly surrounded by the heating element.

This structure substantially evenly transfers heat generated by the heating element to fluid flowing through the tube. Consequently, the fluid heater in the present aspect evenly heats fluid regardless of flow rate of the fluid.

The fluid heater in the above-mentioned aspects may have such a structure that the heat receiving tube accommodates a mixer so as to improve heat exchange efficiency of the fluid.

This structure improves transfer efficiency of heat generated by the heating element. Consequently, the fluid heater in the present aspect evenly heats fluid regardless of flow rate of fluid or fluctuation of fluid flow, and achieves effective utilization of heat generated by the heating element.

The fluid heater in the present aspects may have such a structure that the heat receiving tube has an inner surface and that the heat receiving tube accommodates a mixer, the mixer being located in immediate proximity to the inner surface of the heat receiving tube.

Herein, it is most preferable that the mixer has close contact with the inner surface of the tube because heat is well transferred, but the mixer just has to be located in proximity to the inner surface and may be out of contact with or may have point contact with the inner surface only if heat is sufficiently transferred between the mixer and the inner surface.

This structure causes turbulent flow of fluid in the tube, thereby improving heat transfer efficiency between the outside and the inner atmosphere of the tube. Consequently, the present aspect provides the fluid heater capable of regulating fluid temperature more precisely regardless of flow rate of fluid or fluctuation of fluid flow.

The fluid heater in the above-mentioned aspects may have such a structure that the header has a fin attached thereto.

This structure performs heat exchange of fluid flowing into the header under atmosphere in which the fluid heater is installed, thereby regulating fluid temperature. Further, the above-mentioned structure reinforces the header.

The fluid heater in the present aspects may have such a structure that the header has a header body adapted to introduce gas thereinto, the header body having a fin attached to its outer periphery.

According to this structure, attachment of the fin is easy. Further, the above-mentioned structure avoids irregularities on the inner surface of a heat exchange chamber involved in attachment of the fin. More specifically, according to the present aspect, the fin is attached with maintaining the inner surface of the chamber flat and smooth.

The fluid heater in the present aspect attaches the fin so as to leave no fixing traces or remains such as welding or bonding traces in attaching the fin within the header to be in contact with gas. Thus, heating of fluid by using the fluid heater of the present aspect is safe from contamination of fluid by impurities or metallic ion.

In the fluid heater in the above-mentioned aspects, the heating element may be activated by a direct-current (DC) power source.

This structure continuously regulates current value supplied to the heating element. More specifically, the above-mentioned structure stabilizes current value supplied to the heating element regardless of heat value required for the heating element. Thus, the fluid heater in the present aspect precisely regulates fluid temperature regardless of flow rate of fluid or fluctuation of fluid flow.

The fluid heater in the above-mentioned aspects may include a plurality of the heating elements, wherein the heating elements are mounted and arranged on a plurality of positions on the heat receiving tube in a direction of fluid flow therein.

This structure independently regulates output of each of the heating elements mounted on the heat receiving tube, thereby regulating temperature of fluid flowing through the tube into a desired temperature with certainty.

The fluid heater in the above-mentioned aspects may include a plurality of the heat receiving tubes, each of which has the heating element, whose output is individually controllable.

This structure regulates heating mode of gas in each of the heat receiving tubes. Consequently, the present aspect provides the fluid heater capable of minimizing uneven heating of fluid.

Still another aspect of the present invention provided herein is an evaluation equipment including a fluid passageway for guiding predetermined fluid and a temperature regulator on the fluid passageway, the temperature regulator being provided with a fluid heater, wherein the fluid heater includes a header and a heat receiving tube, the header and the heat receiving tube mutually communicating so that the fluid flows therethrough, and the heat receiving tube having a heating element positioned on the outer periphery of the tube and adapted to generate heat by electric supply.

This structure regulates fluid flowing in the fluid passageway into a predetermined temperature regardless of flow rate of fluid. Consequently, the evaluation equipment in the present aspect performs a high-accuracy evaluation.

In the evaluation equipment in the above-mentioned aspect, the temperature regulator may be provided with a cooler adapted to cool the fluid flowing in the fluid passageway.

This structure provides an evaluation equipment adapted to evaluate under low temperature condition where temperature of fluid flowing in the fluid passageway is lowered.

The evaluation equipment in the above-mentioned aspect may further include a humidity regulator adapted to regulate humidity of the fluid in the fluid passageway.

This structure provides an evaluation equipment adapted to evaluate under a condition wherein humidity of fluid flowing in the fluid passageway is regulated.

The evaluation equipment in the above-mentioned aspect may accommodate an article to be evaluated, and further include an atmosphere regulator adapted to regulate an atmospheric condition into a predetermined evaluation condition, wherein at least a part of the fluid passageway is drawn in the atmosphere regulator and the fluid heater is installed on the part where the fluid passageway is drawn.

This structure provides an evaluation equipment adapted to evaluate using fluid regulated into a desired temperature.

The evaluation equipment in the above-mentioned aspect may evaluate a fuel cell as an article to be evaluated, wherein the fluid is supplied to the fuel cell through the fluid passageway.

This structure provides an evaluation equipment adapted to evaluate a fuel cell with high accuracy regardless of flow rate of fluid or fluctuation of fluid flow.

The evaluation equipment in the above-mentioned aspect may evaluate the fluid flowing in the fluid passageway as an article to be evaluated.

The evaluation equipment in the present aspect precisely regulates fluid temperature even with wide variation of flow rate of fluid to be evaluated. Consequently, the evaluation equipment in the present aspect provides an evaluation equipment adapted to precisely regulate temperature of fluid to be evaluated.

DESCRIPTION OF THE PREFERRED EMBODIMENT

Figure 1:
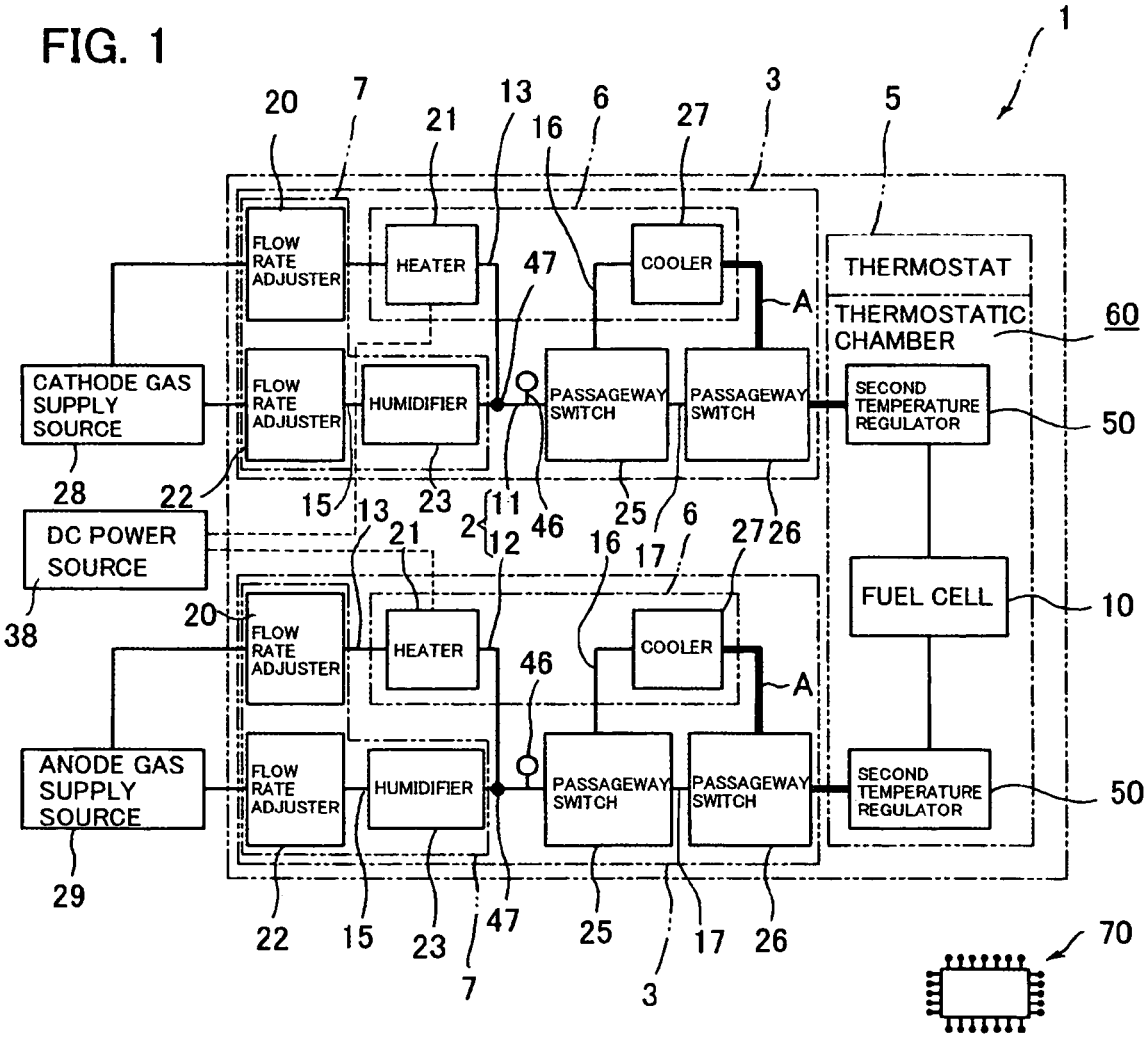
FIG. 1 is a figure of an operating principle of an evaluation equipment embodying the present invention.

Now, an embodiment of the present invention will be described below in detail, making reference to the accompanying drawings. Referring to FIG. 1, the reference numeral 1 denotes a fuel-cell evaluation equipment (hereinafter referred to as an evaluation equipment) 1 in the embodiment.

The evaluation equipment 1 controls supply conditions such as temperature or humidity of gas to be introduced into the cathode of a fuel cell 10 (hereinafter referred to as cathode gas if needed) or gas to be introduced into the anode thereof (hereinafter referred to as anode gas if needed), and evaluates the performance of the fuel cell 10 with the environment condition of installation of the fuel cell 10 controlled. The evaluation equipment 1 is characterized by a structure of a fluid heater 30 or a second temperature regulator 50 both described below.

The evaluation equipment 1, as shown in FIG. 1, consists mainly of a gas passageway 2 for supplying materials such as hydrogen used as an anode active material of the fuel cell 10 or oxygen used as a cathode active material thereof, regulators 3 and 3 each for regulating gas such as the hydrogen or the oxygen passing through the gas passageway 2 into a predetermined temperature or humidity (dew-point), and a thermostat 5 for accommodating the fuel cell 10 to be evaluated.

The gas passageway 2 is a passageway for connecting a supply source of gas such as hydrogen or oxygen to the fuel cell 10 accommodated in the thermostat 5. The gas passageway 2 is constituted by two systems consisting of a cathode gas passageway 11 connected to the cathode (oxygen electrode) of the fuel cell 10 and an anode gas passageway 12 connected to the anode (fuel electrode). The cathode gas passageway 11 and the anode gas passageway 12 are gas flowing ducts for the cathode gas and the anode gas, respectively.

The cathode and anode gas passageways 11 and 12 each have a form of an independent passageway, but their components are substantially the same. More specifically, the cathode and anode gas passageways 11 and 12 each have the regulator 3. Each of the gas passageways 11 and 12 has a passageway switch 25 disposed at the upstream of a cooler 27 described below in a direction of gas flow, and diverges to two systems consisting of a first passageway (also called "low-humidity passageway") 13 for guiding low-humidity gas and a second passageway (also called "high-humidity passageway") 15 for guiding high-humidity gas (i.e., gas with higher humidity than that of the gas flowing in the first passageway 13) at the further upstream of the passageway switch 25. The first and second passageways 13 and 15 merge at the upstream of the passageway switch 25. Each of the gas passageways 11 and 12 further has a cooling passageway 16 at the downstream of the passageway switch 25, the cooling passageway 16 being a passageway for passing the gas flowing in the gas passageway 11 or 12 therethrough to the cooler 27.

Each of the regulators 3 and 3 includes flow rate adjusters 20 and 22, a heater 21, a humidifier 23, the passageway switch 25, another passageway switch 26, and the cooler 27. The flow rate adjuster 20 and the heater 21 are disposed on the first passageway 13, whereas the flow rate adjuster 22 and the humidifier 23 are disposed on the second passageway 15. The passageway switches 25 and 26 are disposed at the boundary between the cooling passageway 16 and a bypass passageway 17 for bypassing the cooling passageway 16. The cooler 27 is disposed on the cooling passageway 16.

More specifically, the first and second passageways 13 and 15 are connected to either a cathode gas supply source 28 or an anode gas supply source 29 (hereinafter referred to as supply sources 28, 29 if needed) being at the outside of the evaluation equipment 1. The flow rate adjusters 20 and 22 respectively determine the flow rate of gas supplied to the first and second passageways 13 and 15.

The heater 21 and the cooler 27 function as a first temperature regulator 6 for regulating the temperature of gas flowing in the cathode or anode gas passageway 11 or 12. The flow rate adjusters 20 and 22 and the humidifier 23 function as a humidity regulator 7 for regulating the humidity (dew point) of gas flowing in the cathode or anode gas passageway 11 or 12. More specifically, in each of the cathode and anode gas passageways 11 and 12, the humidity regulator 7 regulates the humidity of gas supplied to the fuel cell 10 by adjusting a mixing ratio of low-humidity gas flowing in the first passageway 13 and high-humidity gas flowing in the second passageway 15 by means of the flow rate adjusters 20 and 22 and also regulating the humidity of gas flowing in the second passageway 15 by means of the humidifier 23.

Referring to FIG. 1, the first and second passageways 13 and 15 merge at the downstream of the heater 21 and the humidifier 23. Thereby, the flow rate adjusters 20 and 22 adjust a mixing ratio of high- and low-humidity gas, so as to supply gas at a desired humidity to the fuel cell 10.

Figure 2A:
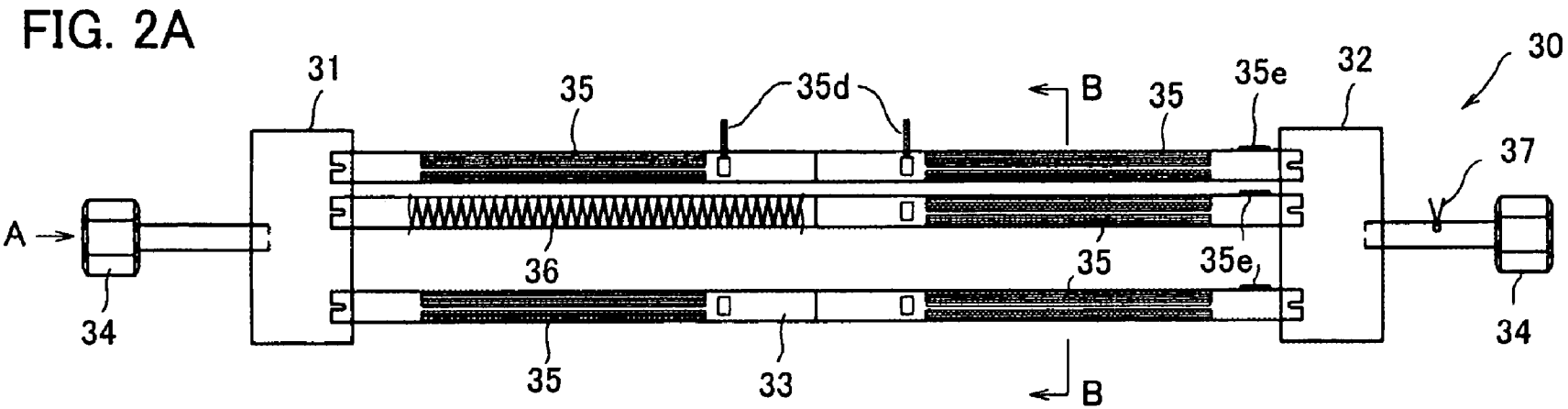
FIG. 2A is a front view of a fluid heater employed in the evaluation equipment shown in FIG. 1.
Figure 2C:
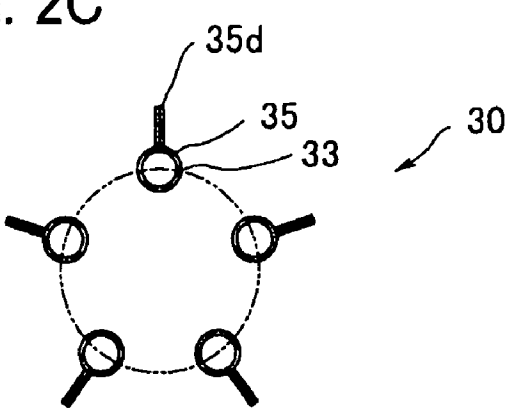
FIG. 2C is a cross-sectional view of the heater as taken along B-B of FIG. 2A.
Figure 2B:
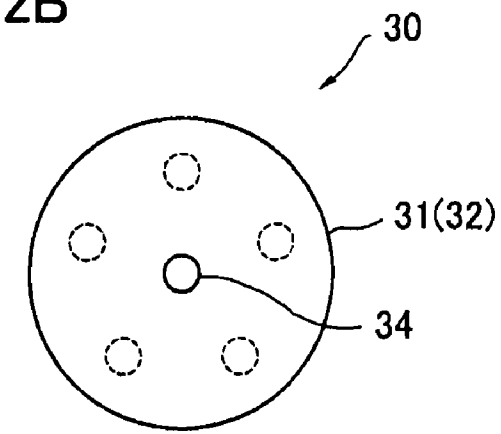
FIG. 2B is a side view of the fluid heater as taken from direction A of FIG. 2A.

The heater 21 is provided with a fluid heater 30 having a unique structure as shown in FIG. 2. The fluid heater 30 in the cathode gas passageway 11 has an identical structure with that in the anode gas passageway 12. Specifically, the fluid heater 30 is constituted by two headers 31 and 32, which have the same shape, and a plurality of (five in the present embodiment) heat receiving tubes 33 attached to and connecting the headers 31 and 32. The headers 31 and 32 each have a hollow cylindrical shape made of thin metal and include a connecting part 34 for connecting with the gas passageway 2. More specifically, the headers 31 and 32 each are of a cylindrical shape with a thickness of about 0.6-1.0 mm. Thus, the headers 31 and 32 each have small heat capacity and good heat transfer characteristic.

The header 31 is connected to the heat receiving tubes 33 at their upstream ends in a direction of gas flow. The header 31 forms a cavity into which gas having flown from the upstream of the gas passageway 2 flows, and divides the gas having introduced into the cavity into the five heat receiving tubes 33. The header 32 is connected to the heat receiving tubes 33 at their downstream ends in a direction of the gas flow and forms a cavity into which the gas passing through each of the tubes 33 flows. An effluent gas temperature sensor 37 for detecting temperature of gas passing through the fluid heater 30 is positioned adjacent to the connecting part 34 constituting an outlet of the header 32. The sensor 37 detects a discharge temperature of gas flowing from each of the tubes 33 into and merging at the header 32.

The heat receiving tubes 33 each are a cylinder having a small outer diameter and made of a material with good heat conductance such as a metal and communicate with inner cavities of the headers 31 and 32. The heat receiving tubes 33 each are a tube made of thin metal as well as the headers 31 and 32. In the present embodiment, the heat receiving tube 33 employs a tube made of a metal such as a stainless steel such as austenitic stainless steel, for example, SUS316L specified by JIS with a thickness (t1) of about 0.6-1.0 mm.

The heat receiving tubes 33 each have such a structure that its inner atmosphere reaches a high temperature when a heating element 35 mounted on the outer surface of the tube 33 is energized. Specifically, each of the heat receiving tubes 33 has two heating elements 35 and 35 arranged in tandem in a longitudinal direction. Further, each of the heat receiving tubes 33 has a surface temperature sensor 35*e* for controlling surface temperature positioned on its outer surface adjacent to the header 32.

Figure 4A:
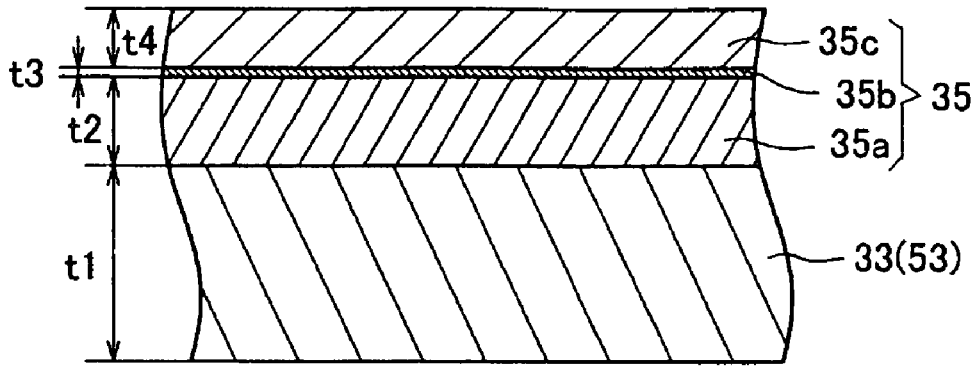
FIG. 4A is a cross-sectional view of a laminated structure of a heat receiving tube and a heating element.

Referring to FIG. 4A, each of the heating elements 35 and 35 has a trilaminar structure. More specifically, the heating element 35 consists of an electrical insulating layer 35*a* formed on the outer surface of the tube 33, a heating layer 35*b* formed on the surface of the insulating layer 35*a*, and a covering layer 35*c* covering the surface of the heating layer 35*b*.

The insulating layer 35*a* is a filmy lamellar body made of a vitreous material and formed on the outer surface of the metal heat receiving tube 33, and is firmly fixed on the surface of the tube 33. The insulating layer 35*a* is a layer intervening between the heating layer 35*b* and the tube 33 and has little electrical conductivity. The insulating layer 35*a* is a thin filmy layer. Specifically, in the present embodiment, the insulating layer 35*a* has a thickness (t2) of about 120-130 μm. Therefore, heat generated in the heating layer 35*b* is smoothly conducted to the heat receiving tube 33 across the insulating layer 35*a*. Consequently, the insulating layer 35*a* is a layer with excellent electrical insulation and excellent heat conductivity.

The heating element 35*b* is interposed between the insulating layer 35*a* and the covering layer 35*c*, as shown in FIG. 4A. The heating layer 35*b* is formed by applying and heat-curing (baking) on the insulating layer 35*a* a paste made of a material to be a resistive heating element upon applying current such as silvery paste as typified by a silver palladium paste, a silver paste, or a silver platinum paste. In the present embodiment, the heating layer 35*b* is formed by means of a screen printing method. The heating layer 35*b* may be printed by means of not only the screen printing method but also conventional methods such as a dispenser method or a photo engraving method as typified by a photolithographic method, but it should be preferably printed by a screen printing method to avoid undesired distribution of heat generation resulting from reasons such as imprecise printing of the heating layer 35*b* and regional variation of resistance, which results from uneven cross-sectional area (thickness) of the heating layer 35*b*.

Figure 4B:
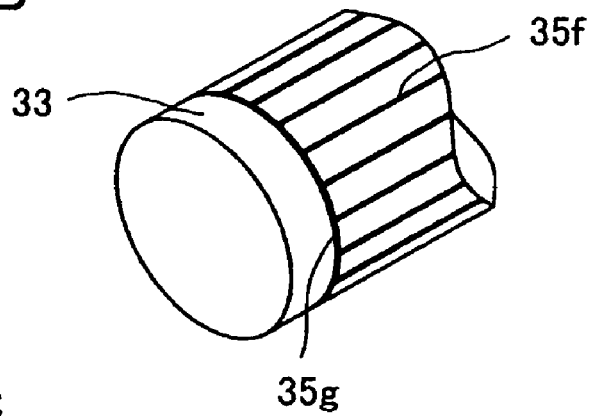
FIG. 4B is a schematic diagram showing a positional relationship of resistive parts of the heating element to the heat receiving tube.
Figure 4C:
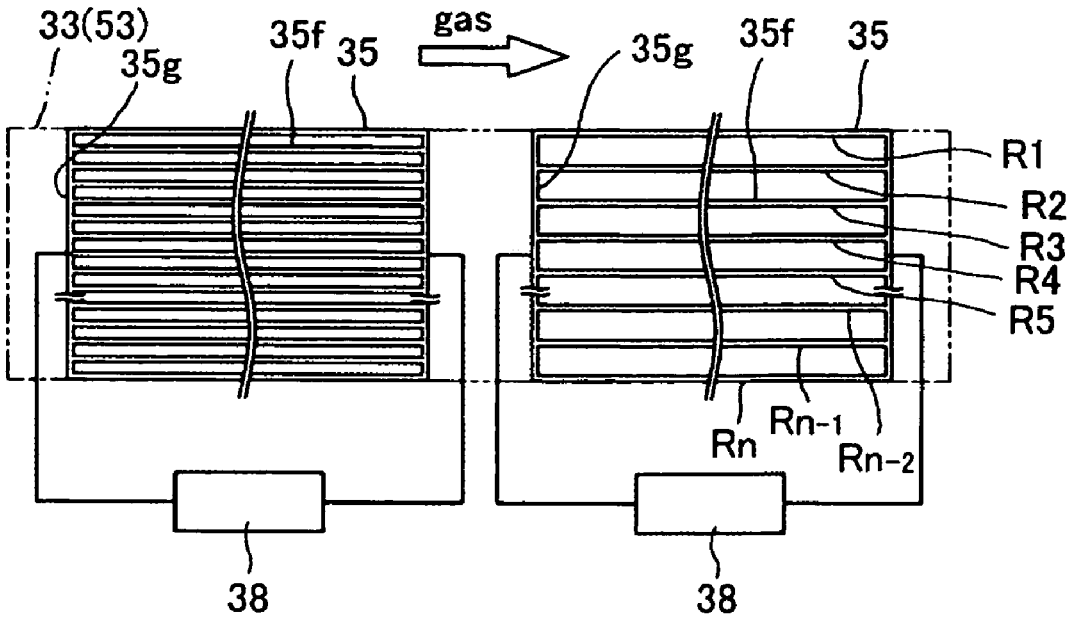
FIG. 4C is a schematic diagram showing a relationship between the resistive parts of the heating element positioned on the heat receiving tube and a DC power source.

Referring to FIGS. 4B and 4C, the heating layer 35*b* has a plurality of resistive parts (heating parts) 35*f* linearly extending along an extending direction (in a longitudinal direction) of the heat receiving tube 33. The resistive parts 35*f*, as shown in FIG. 4B, are arranged at equal intervals around the circumference of the tube 33. Both ends of the adjacent resistive parts 35*f* around the circumference of the tube 33 are mutually connected by connecting parts 35*g*, so that each of the resistive parts 35*f* is connected in parallel to a direct-current (DC) power source 38.

The heating element 35*b* has a width (length extending along the circumference of the tube 33), a length (length in an extending direction of the tube 33), and a thickness all adjusted so that each electric resistance of the resistive parts 35*f* is substantially the same. Herein, the material of the heating element 35*b* in the present embodiment has such a tendency that its resistance widely varies with temperature and that the higher in temperature, the higher in resistance. Therefore, in the case that resistances of the resistive parts 35*f* arranged in parallel as shown in FIG. 4C, for example, are designated as R1, R2, . . . , Rn in sequence, if and when temperature of the resistive parts 35*f* with resistance RI becomes higher than that of each of the other resistive parts 35*f*, the resistance R1 becomes higher than each of the other resistances R2, . . . , Rn. That results in less electric current flowing through the resistive part 35*f* with resistance R1 than electric current flowing through the other resistive parts 35*f*, and in a lower heat generation at the resistive part 35*f* with resistance R1 than heat generations at the other resistive parts 35*f*. By contraries, if and when temperature of the resistive part 35*f* with resistance R1 becomes lower than that of the other resistive parts 35*f*, the resistance R1 becomes low, with a consequence of a higher heat generation at the resistive part 35*f* with resistance R1. Consequently, even though having unevenness in temperature, the heating element 35 relatively alters ratios of resistances R1, R2, . . . Rn at the resistive parts 35*f* in response to unevenness in temperature, thereby making temperature around the resistive parts 35*f* substantially even and heating gas flowing in the heat receiving tube 33 substantially evenly.

The heating layer 35*b* has a thickness of roughly one-ninth to one-eighth of that of the insulation layer 35*a*. In the present embodiment, the heating layer 35*b* has a thickness (t3) of about 15 μm. An electrode 35*d* for electric supply is attached to the heating layer 35*b*, as shown in FIG. 2A.

As described above, the heating elements 35 and 35 or the heating layers 35*b* and 35*b* that are essential components thereof are separately positioned in two places in a longitudinal direction. Referring to FIG. 4C, the heating element 35 (hereinafter referred to as an upstream heating element 35, if needed) positioned at the upstream of gas flow (in the present embodiment, adjacent to the header 31) on the heat receiving tube 33 and the heating element 35 (hereinafter referred to as a downstream heating element 35, if needed) positioned at the downstream of gas flow (in the present embodiment, adjacent to the header 32) on the tube 33 are separately connected to the corresponding DC power sources 38 and 38. The upstream heating element 35 and the downstream heating element 35 have different power density adapted to be supplied to the corresponding heating layers 35*b* and 35*b*.

More specifically, as shown in FIG. 4C, the upstream heating element 35 has a higher arrangement density of the resistive parts 35*f* constituting the heating layer 35*b* than the downstream heating element 35. Thereby, power density capable of being supplied to the upstream heating element 35 is adjusted to be higher than that to the downstream heating element 35. That is for precisely regulating gas temperature even with wide variation of gas flow rate required for an evaluation of an article to be evaluated such as the fuel cell 10 performed by the evaluation equipment 1, and thus the embodiment is constituted so that heating capacity varies along a direction of gas flow in the heat receiving tube 33. The present embodiment has such a structure that temperature of the heat receiving tube 33 at the upstream in a direction of gas flow is higher than that at the downstream.

Referring to FIG. 4C, the heating layers 35*b* and 35*b*, which are formed in two places in a longitudinal direction of the heat receiving tube 33, are electrically independent. Power supply or heat generation in each of the heating layers 35*b* and 35*b* is controlled by a feedback system based on the surface temperature of the heating element 35 detected by the surface temperature sensor 35*e*, as shown in FIG. 2A, attached to the covering layer 35*c* to be described below.

The covering layer 35*c* is a filmy lamellar body made of a vitreous material as well as the above-mentioned insulating layer 35*a* and is formed so as to cover the heating layer 35*b*. The electrodes 35*d* attached to the heating layer 35*b* protrude from the covering layer 35*c*. The covering layer 35*c* has little electrical conductivity as well as the insulating layer 35*a*. The covering layer 35*c* has a thickness (t4) of about 60-90 μm.

Each of the surface temperature sensors 35*e* is attached to the surface of the covering layer 35*c* and at the downstream in a direction of gas flow into the fluid heater 30, or at a position adjacent to the header 32. The sensor 35*e* is attached to each of the five heat receiving tubes 33 constituting the fluid heater 30. Each of the sensors 35*e* detects the surface temperature of the heating element 35 adjacent to the downstream end in a direction of gas flow on the heat receiving tube 33 to which the sensor 35*e* is attached. Output of each of the heating elements 35 and 35 mounted on each of the heat receiving tubes 33 is controlled by a feedback system based on the surface temperature of the heating element 35 detected by each of the sensors 35*e*.

The fluid heater 30 has the heating elements 35 in ten places in all with two heating elements 35 and 35 arranged in tandem on each of five heat receiving tubes 33. The heating elements 35 and 35 are independently connected to the corresponding DC power sources 38 and 38. Each of the heating elements 35 and 35 is controlled by a feedback system based on surface temperature of the heating element 35 detected by the surface temperature sensors 35*e* attached adjacent to the downstream end in a direction of gas flow through the heat receiving tubes 33 and on discharging temperature of gas detected by the effluent gas temperature sensor 37 attached adjacent to the connecting part 34.

Figure 3B:
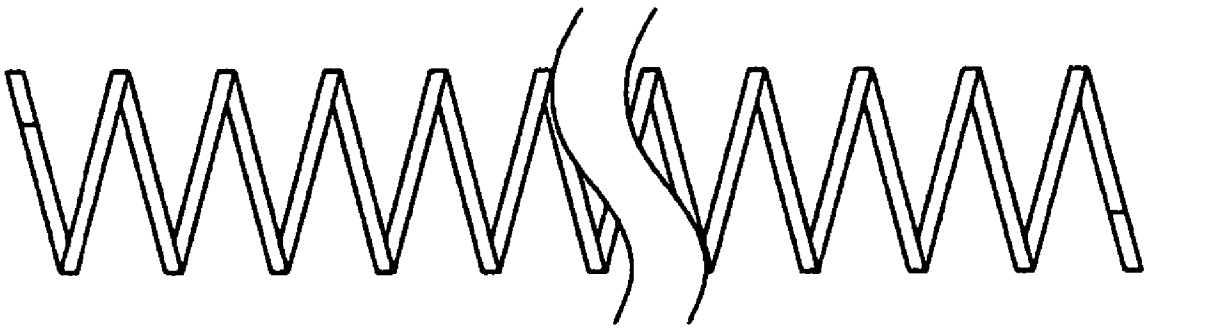
FIG. 3B is a side view of the mixer.
Figure 3A:
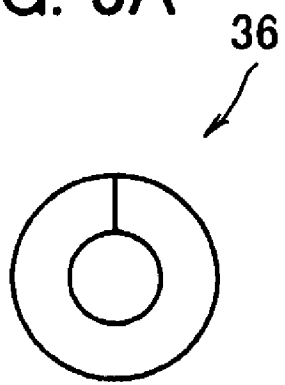
FIG. 3A is a front view of a mixer.

The heat receiving tubes 33 each accommodate a static mixer 36. The mixer 36 is, as shown in FIG. 3, a spring-like member made by winding a metal strip or belt in a spiral configuration and is, as shown in FIG. 2A, in very close contact with the inner surface of the tube 33. Thereby, if and when the heating element 35 arranged at the outer surface of the tube 33 rises in temperature, generated heat is smoothly transferred to the mixer 36, thereby raising its temperature.

Collision of gas introduced into the heat receiving tubes 33 with the mixers 36 causes turbulent flow, thereby mixing gas. Therefore, gas introduced into the fluid heater 30 is smoothly heated in the heat receiving tubes 33. Consequently, in the case, for example, that the fluid heater 30 is connected in such a way that the header 31 is located at the upstream in a direction of gas flow in the first (low-humidity) passageway 13, the gas having flown from the first passageway 13 in the header 31 is divided into the heat receiving tubes 33, and the gas divided into each of the tubes 33 is heated during flowing in the tube 33 before being merged at the header 32, whereupon the gas returns to the first passageway 13.

Figure 5:
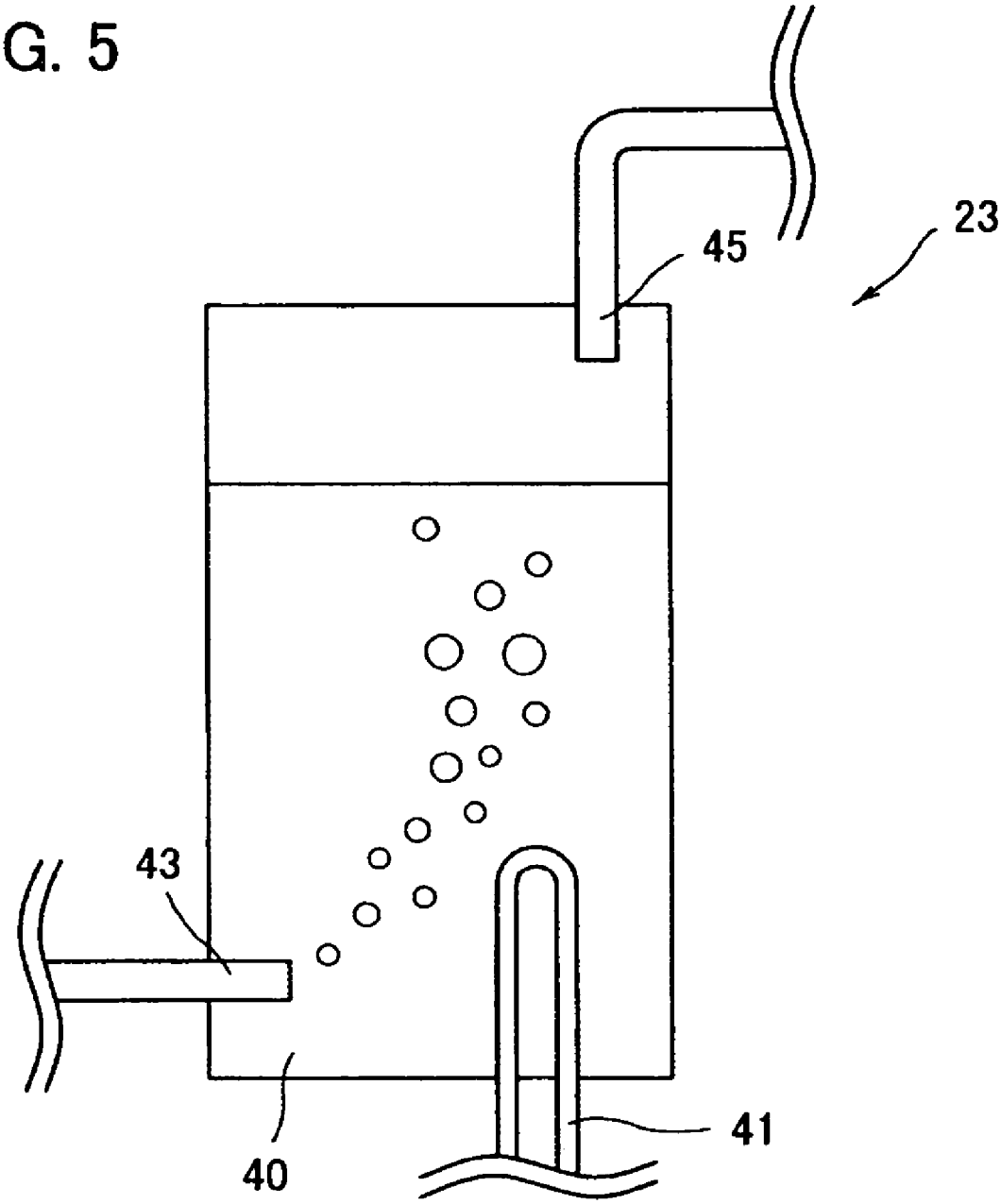
FIG. 5 is a schematic diagram showing a humidifier employed in the evaluation equipment shown in FIG. 1.

Referring to FIG. 5, the humidifier 23 is provided with a reservoir 40 hermetically sealed for storing water and a heater 41 for heating the water in the reservoir 40. Generally, pure water is employed as the water stored in the reservoir 40, but other waters may be employed depending on test conditions and the like. The reservoir 40 has at its lower side a gas inlet 43 for introducing gas flowing in the second passageway 15 after passing through the flow rate adjuster 22 into the stored water in the reservoir 40. The reservoir 40 has at its upper side a gas outlet 45 for discharging the gas introduced into the stored water out to the downstream of the humidifier 23. The gas flowing in the second passageway 15 after passing though the flow rate adjuster 22 is introduced into stored water heated at a predetermined temperature by the heater 41, then being treated with so-called bubbling. The gas introduced into the reservoir 40 is humidified at a predetermined humidity so as to be discharged from the gas outlet 45. Feedback control is made on output of the heater 41 based on dew point (humidity) measured by a dew point meter 46 (see FIG. 1) disposed at the downstream of the gas output 45.

Referring to FIG. 1, the first passageway 13 and the second passageway 15 merge at a merging point 47 formed at the downstream of the heater 21 and the humidifier 23. Gas at low humidity (hereinafter referred to as low-humidity gas if needed) having passed through the first passageway 13 and gas at high humidity (hereinafter referred to as high-humidity gas if needed) having passed through the second passageway 15 are mixed at the merging point 47, so that the mixed gas is delivered towards the downstream (the fuel cell 10 side) with the temperature and humidity of the gas regulated.

The cooler 27 is located on the cooling passageway 16 disposed at the downstream of the merging point 47. The passageway switches 25 and 26 are disposed at the boundary between the cooling passageway 16 and the bypassing passageway 17 of the cathode gas passageway 11 or the anode gas passageway 12. The passageway switches 25 and 26 each employ a three port connection valve. Both of the passageway switches 25 and 26 become open into either the cooling passageway 16 or the bypassing passageway 17 of the cathode gas passageway 11 (or of the anode gas passageway 12). Thus, when the passage switches 25 and 26 is made open into the cooling passageway 16, gas having passed through the merging point 47 is led to the cooler 27 so as to be cooled. By contraries, when the passage switches 25 and 26 are made to close the cooling passageway 16, gas having passed through the merging point 47 is led towards the fuel cell 10 bypassing the cooler 27.

In the evaluation equipment 1, if and when gas flowing in the upstream of the merging point 47 is at high humidity, the gas flows into the cooling passageway 16 and is cooled by the cooler 27, resulting in freezing within the cooling passageway 16 or the cooler 27, with the result of possibly posing a problem for operations of these devices. The evaluation equipment 1 builds in an interlock mechanism that prevents the passageway switches 25 and 26 from opening into the cooling passageway 16, that is, prevents gas from flowing into the cooling passageway 16, if required, based on dew point (humidity) of gas passing through the cathode gas passageway 11 or the anode gas passageway 12. More specifically, the evaluation equipment 1 makes the passageway switches 25 and 26 not to become open into the cooling passageway 16 in the case that gas flowing into the cooling passageway 16 is supposed to bring about problems for operations of the cooler 27 and the like based on operating conditions such as humidity (dew point) of gas passing through the cathode gas passageway 11 or the anode gas passageway 12 or an operating temperature of the cooler 27.

The cooler 27 is positioned adjacent to and at the upstream of the thermostat 5 in a direction of gas flow so as to prevent low-temperature gas cooled by the cooler 27 from being warmed before being supplied to the fuel cell 10 installed in the thermostat 5. Specifically, in the evaluation equipment 1, the cooler 27 is located at a position capable of shortening to a minimum a duct as shown in heavy line A in FIG. 1, that is, a duct led from the exit side of the cooler 27 through the passage switch 26 to a second temperature regulator 50 (fluid heater) in the thermostat 5 described below. More specifically, in the case that the cathode and anode gas passageways 11 and 12 each employ a duct of 12.7 mm (½ inch) in diameter and that gas flow is variable in rate in a range 0.5 L/m-240 L/m, the duct A is preferably 50 cm or less in length, and more preferably 30 cm or less.

Figure 6A:
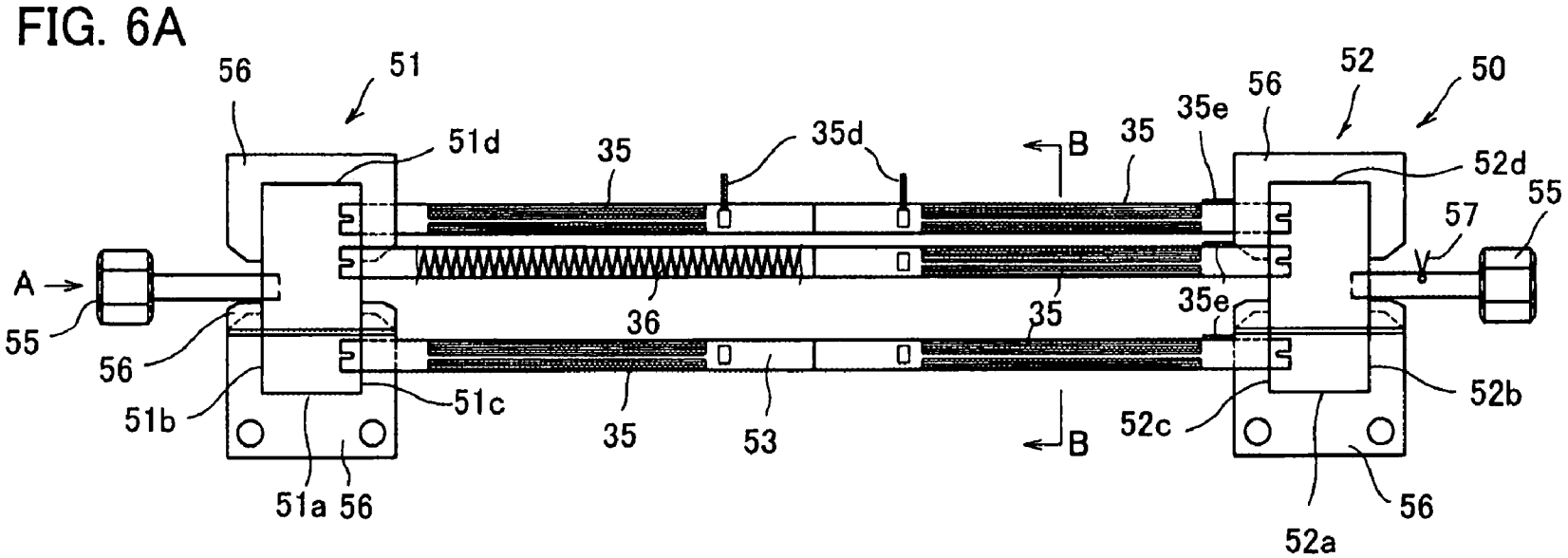
FIG. 6A is a front view of a second temperature regulator employed in the evaluation equipment shown in FIG. 1.
Figure 6C:
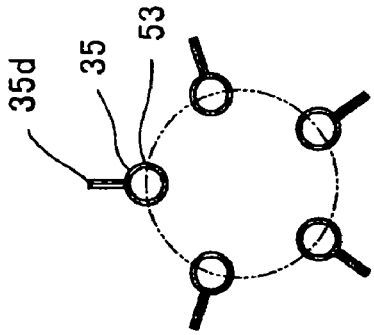
FIG. 6C is a cross-sectional view of the second temperature regulator as taken along B-B of FIG. 6A.
Figure 6B:
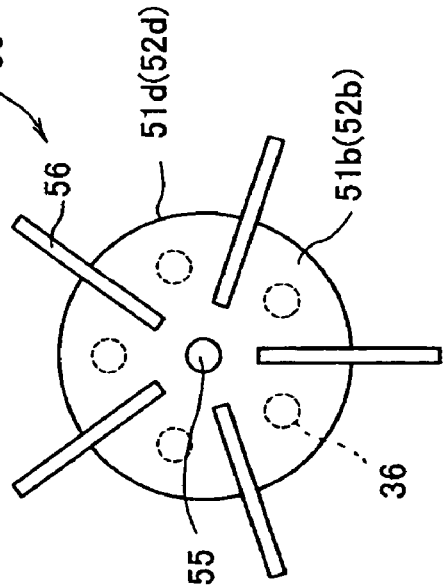
FIG. 6B is a side view of the second temperature regulator as taken from direction A of FIG. 6A.
Figure 7:
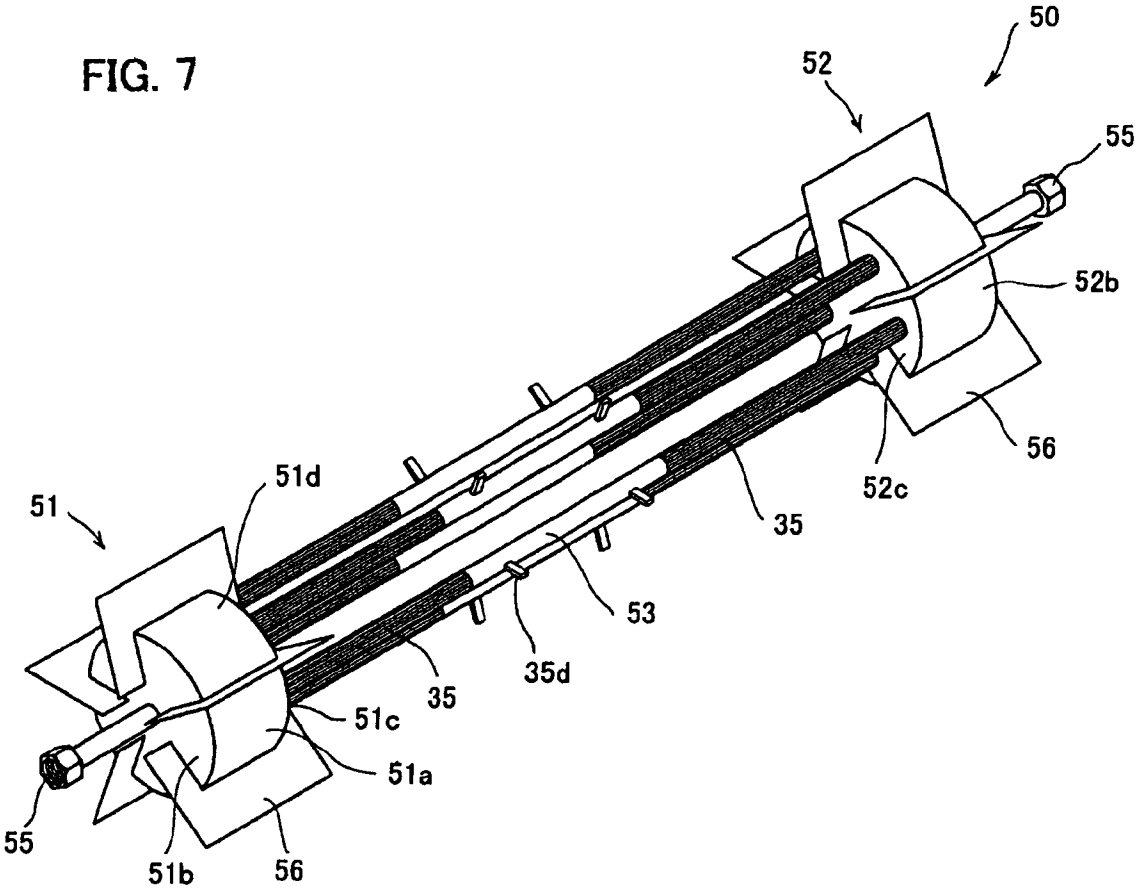
FIG. 7 is a perspective view of the second temperature regulator shown in FIG. 6A.

Portions of the cathode and anode gas passageways 11 and 12 at the downstream of the passageway switches 26 and 26 are drawn into the thermostat 5, and then connected to the second temperature regulators 50 and 50. The second temperature regulators 50 and 50 are of the identical structure in both of the cathode and anode gas passageways 11 and 12. Referring to FIGS. 6 and 7, the second temperature regulator 50 has a structure mostly common with the above-mentioned heater 21. More specifically, the second temperature regulator 50 includes headers 51 and 52 and heat receiving tubes 53. The headers 51 and 52 each have a cylindrical shape as well as the headers 31 and 32 of the heater 21. The second temperature regulator 50 is connected in such a way that one header 51 is positioned at the upstream in a direction of gas flow in the gas passageway 2 and the other header 52 is positioned at the downstream.

The headers 51 and 52 respectively have header bodies 51*a* and 52*a* each of a short cylindrical shape and fins (fin-like members) 56 attached thereto by a means such as welding. The header bodies 51*a* and 52*a* each have a hollow cylindrical shape made of a material with good heat conductance such as a stainless steel such as austenitic stainless steel, for example, SUS316L specified by JIS with a thin thickness (t1) of about 0.6-1.0 mm. Thus, the headers 51 and 52 each have small heat capacity and good heat transfer characteristic. The header bodies 51*a* and 52*a* have at their outer end faces 51*b* and 52*b* connecting parts 55 and 55 for connecting the second temperature regulator 50 to the cathode or anode gas passageway 11 or 12. Further, an effluent gas temperature sensor 57 for detecting temperature of gas effluent from the header 52 is positioned adjacent to the connecting part 55 of the header 52 located at the downstream of gas flow.

As the headers 51 and 52 are formed of thin plates, they are extremely lightweight and have little heat capacity. Inner surfaces of the header bodies 51*a* and 52*a* are processed by plating or polishing such as mirror grinding and lapping, so as to maintain the inner surfaces clean and protect gas from contamination by foreign bodies. Thereby, operation of the evaluation equipment 1 over a long period of time causes little adhesion of foreign bodies, so as to hardly cause contamination of gas or reduction of heat conductivity. Further, the header bodies 51*a* and 52*a* have uniform heat transfer resistances because of their clean inner surfaces. Consequently, the headers 51 and 52 have high heat exchange efficiency between gas introduced into the headers 51 and 52 and outer atmosphere of the headers 51 and 52, or inner atmosphere within the thermostatic chamber 60 in which the second temperature regulator 50 is installed, thereby ensuring uniform and even heat exchange of gas introduced into the headers 51 and 52 under inner atmosphere in the thermostatic chamber 60.

As described above, being made of metal thin plates, the header bodies 51*a* and 52*a* may expand or contract depending on a state of gas inflow. However, since the header bodies 51*a* and 52*a* are cylindrically formed, force to expand or contract the header bodies 51*a* and 52*a* acts on the whole header bodies 51*a* and 52*a* substantially evenly. Consequently, the headers 51 and 52 have high rigidity, so that usage of the evaluation equipment 1 over a long period of time hardly causes damage to the headers 51 and 52.

The headers 51 and 52 have the fins 56 secured to the outer surface of the header bodies 51*a* and 52*a* so as to improve heat transfer characteristic or rigidity. More specifically, the headers 51 and 52 each have a plurality (five in the present embodiment) of the fins 56 radially secured to the outer periphery thereof at equal intervals. The fins 56 each are a metal plate formed so as to be substantially rectangular U-shape in a plan view. The fins 56 have a combination of a function of a member for reinforcing the header bodies 51*a* and 52*a* made of thin plates and a function of increasing of heat receiving areas of the headers 51 and 52.

Referring to FIGS. 6 and 7, the fins 56 are secured by a method such as welding in such a way as having contact with outer end faces 51*b* and 52*b*, inner end faces 51*c* and 52*c*, and also the cylindrical faces 51*d* and 52*d* from the outside of the header bodies 51*a* and 52*a*. Specifically, each of the fins 56 is secured in such a way as sandwiching the header body 51*a* or 52*a* therebetween. In other words, the fins 56 are secured in such a way as extending in a direction along the axis of the header bodies 51*a* and 52*a* and over the axial length of the header bodies 51*a* and 52*a*. Thus, the headers 51 and 52 have large contact areas between the fins 56 and the header bodies 51*a* and 52*a*, thereby ensuring smooth heat transfer between the fins 56 and the headers 51 and 52.

The headers 51 and 52 have the fins 56 secured thereto from the outside of the header bodies 51*a* and 52*a*, so that inner surfaces of the header bodies 51*a* and 52*a* are smooth. Therefore, the inner surfaces of the header bodies 51*a* and 52*a* are almost free from stain even after a long-term use.

A plurality (five in the present embodiment) of the heat receiving tubes 53 are connected to the inner end faces 51*c* and 52*c* of the header bodies 51*a* and 52*a*. The tubes 53 each communicate with the inner cavity of each of the header bodies 51*a* and 52*a*. Thus, the second temperature regulator 50 divides gas having flown into the header body 51*a* located at the upstream in a direction of gas flow into streams in each of the heat receiving tubes 53 and brings the gas passing through each of the tubes 53 together in the header body 52*a*, and then discharges the merged gas from the header body 52*a*.

The heat receiving tube 53 is a tube made of a thin material with good heat conductance such as a stainless steel with a thickness (t1) of about 0.6-1.0 mm as well as the heat receiving tube 33 employed in the fluid heater 30 described above. Two heating elements 35 and 35 are positioned on the outer surface of the tube 53.

The heating elements 35 and 35 each have the same structure as those having the same reference numeral and employed in the fluid heater 30 described above and generate heat upon power supply from the DC power source 38. More specifically, the heating element 35, as shown in FIG. 4, has a trilaminar structure having the heating element 35*b* interposed between the insulating layer 35*a* made of a vitreous material and fixed on the surface of the heat receiving tube 53 and the covering layer 35*c* made of a vitreous material. The heating layer 35*b* is formed by printing and heat-curing (baking) on the surface of the insulating layer 35*a* a paste containing materials to be resistive heating element such as a silver palladium paste by a method such as a screen printing method.

The heating elements 35 and 35 are positioned with a predetermined interval therebetween at a center in a longitudinal direction of each of the heat receiving tubes 53 and generate heat by electric supply so as to heat the inner atmosphere in the tube 53. The two heating elements 35 and 35 mounted on each of the tubes 53 are electrically independent. Power supplied to each of the heating elements 35 and 35 is controlled by a feedback system based on surface temperature thereof detected by the surface temperature sensor 35*e* positioned on the covering layer 35*c* of the heating element 35 at the downstream end in a direction of gas flow through the tube 53. Therefore, even with temperature gradient of gas within the tube 53, for example, control of outputs of the heating elements 35 and 35 at inlet and outlet sides (adjacent to the headers 51 and 52) of the tube 53 enables to regulate temperature of gas discharged from the tube 53 into a suitable temperature.

In the present embodiment, the second temperature regulator 50 has the heating elements 35 in ten places in all with two heating elements 35 and 35 arranged in tandem on each of five heat receiving tubes 53. The heating elements 35 and 35 are independently connected to the corresponding DC power sources 38 and 38. Each of the heating elements 35 and 35 is controlled by a feedback system based on surface temperature of the heating element 35 detected by the surface temperature sensor 35*e* attached adjacent to the downstream end in a direction of gas flow through the heat receiving tubes 53 and on discharging temperature of gas detected by the effluent gas temperature sensor 37.

The heat receiving tube 53 accommodates the static mixer 36 as shown in FIG. 3, as well as the heat receiving tube 33 of the heater 21 described above. The mixer 36 has an effect on improving heat exchange efficiency of gas by disturbing gas flow introduced into the tube 53 to cause turbulent flow.

The mixer 36 is in close contact with the inner surface of the tube 53. Further, as well as the heat receiving tube 33 described above, the heating elements 35 and 35 are positioned on the outer surface of the tube 53. Thereby, heat generated during operation of the heating elements 35 and 35 is transferred through the tube 53 and the mixer 36 to heat gas introduced into the tube 53.

The thermostat 5 has the thermostatic chamber 60 and regulates atmosphere within the thermostatic chamber 60 into a predetermined temperature, as well as conventional thermostats. The thermostatic chamber 60 has space for accommodation of an article to be evaluated such as the fuel cell 10 and the second temperature regulator 50 and 50.

Now, operations of the evaluation equipment 1 in the present embodiment are described in detail below. The evaluation equipment 1 is provided with a controller 70 whereby an operation of each part is controlled. The controller 70 controls operations of parts such as the regulators 3 and 3 and the thermostat 5 based on signals by meters such as dew point meters or temperature sensors disposed at various parts of the evaluation equipment 1.

Before starting an evaluation of the fuel cell 10, the controller 70 starts up the thermostat 5 so as to control an inner atmospheric temperature in the thermostatic chamber 60, that is, an atmospheric temperature in which the fuel cell 10 is installed. The controller 70 also controls operations of the regulators 3 and 3 and the second temperature regulators 50 and 50 based on conditions such as a preset temperature, humidity (dew point), and flow rate of the cathode gas and the anode gas preset according to a test condition of the fuel cell 10.

Specifically, the evaluation equipment 1 controls the temperature and humidity of the cathode and anode gas supplied to the fuel cell 10. The evaluation equipment 1 supplies to the fuel cell 10 the gas in a state heated at a higher temperature than that of gas supplied from the supply sources 28 and 29, and as well supplies to the fuel cell 10 the gas in a state cooled at a lower temperature than that of gas supplied from the supply sources 28 and 29. More specifically, the evaluation equipment 1 performs tests not only in a high-temperature test mode carried out by supplying gas heated up to and over a supply temperature K of gas supplied from the supply sources 28 and 29 to the fuel cell 10, but also in a low-temperature test mode carried out by supplying gas cooled below the supply temperature K to the fuel cell 10. Consequently, the evaluation equipment 1 in the present embodiment performs an operation test of the fuel cell 10 in a range from −30° C. to 120° C.

When the evaluation equipment 1 operates in the high-temperature test mode, the controller 70 determines temperature and flow rate of cathode gas at low humidity (hereinafter referred to as low-humidity cathode gas if needed) supplied through the first passageway (low-humidity passageway) 13 of the cathode gas passageway 11 and cathode gas at high humidity (hereinafter referred to as high-humidity cathode gas if needed) supplied through the second passageway (high-humidity passageway) 15 of the cathode gas passageway 11, based on temperature and humidity of cathode gas to be supplied to the fuel cell 10. Similarly, the controller 70 controls temperature and flow rate of anode gas at low humidity (hereinafter referred to as low-humidity anode gas if needed) supplied through the first passageway 13 of the anode gas passageway 12 and anode gas at high humidity (hereinafter referred to as high-humidity anode gas if needed) supplied through the second passageway 15 of the anode gas passageway 12, based on temperature and humidity of anode gas to be supplied to the fuel cell 10.

The controller 70 controls the flow rate adjusters 20 and 22, output of the heating elements 35 of the heater 21, output of the heater 41 of the humidifier 23, and the like of each of the regulators 3 and 3 disposed at the cathode and anode gas passageways 11 and 12, in order to control flow rate or humidity of the high-humidity cathode gas, low-humidity cathode gas, high-humidity anode gas, and low-humidity anode gas. On the basis of the result obtained herein, the controller 70 controls the flow rate adjusters 20 and 22, output of the heating elements 35 of the heater 21, and output of the heater 41 of the humidifier 23.

Herein, output of each of the heating elements 35 mainly constituting the heater 21 is independently controlled. More specifically, output of each of the heating elements 35 is controlled by a feedback system based on a surface temperature of the heating element 35 detected by the surface temperature sensor 35*e* attached to the heat receiving tube 33 and gas temperature detected by the effluent gas temperature sensor 37 attached adjacent to the outlet of the header 32. Thereby, the fluid heater 30 substantially evenly heats gas flowing in each of the tubes 33 by fine control of output of each of the heating elements 35. The gas heated by the fluid heater 30 passes through the first passageway 13 to merge at the merging point 47 with gas humidified by the humidity regulator 7 and passing through the second passageway 15, so as to be gas with regulated temperature and humidity.

When the evaluation equipment 1 operates in the high-temperature test mode, the cooler 27 basically does not operate. Therefore, in the high-temperature test mode, both of the passageway switches 25 and 26 are made to close the cooling passageway 16, so that the cathode or anode gas flows into the second temperature regulator 50 bypassing the cooler 27.

If and when temperature of cathode or anode gas effluent from the second temperature regulator 50, that is, temperature detected by the effluent gas temperature sensor 57 is substantially the same as a predetermined temperature, the cathode or anode gas can be supplied to the fuel cell 10 without any modification. Therefore, in this state, the controller 70 does not start up the heating elements 35 mounted to the second temperature regulator 50. The cathode or anode gas flowing into the header 51 is discharged from the header 51 through the heat receiving tube 53 and the header 52 out of the second temperature regulator 50 to be supplied to the fuel cell 10. Herein, as described above, the second temperature regulators 50 and 50 are accommodated in the thermostatic chamber 60. Further, especially having the header bodies 51*a* and 52*a* each made of a thin metal plate further with the fins 56, the second temperature regulator 50 has high heat exchange efficiency. Consequently, the cathode or anode gas is heat exchanged during passing through the headers 51 and 52 or the heat receiving tubes 53, and is supplied to the fuel cell 10 at a finely regulated temperature.

On the other hand, if and when cathode or anode gas having flown into the second temperature regulator 50 is below a temperature to be supplied to the fuel cell 10, it is necessary to heat the cathode or anode gas before supplying to the fuel cell 10. Herein, the evaluation equipment 1 controls flow rate of the cathode or anode gas supplied to the fuel cell 10 in a wide range. Specifically, the evaluation equipment 1 in the present embodiment controls flow rate of cathode or anode gas supplied to the fuel cell 10 in a range 0.5 L/m-200 L/m. The controller 70 controls power supply to the heating elements 35 mounted to the heat receiving tubes 53 of the second temperature regulator 50 in response to flow rate of the cathode or anode gas supplied to the fuel cell 10.

More specifically, if and when flow rate of cathode or anode gas is controlled to a very small rate equivalent to 0.5 L/m, the cathode or anode gas flows in the second temperature regulator 50 at a speed of near-stopping condition. Thus, the controller 70 does not apply current to the heating elements 35 when a temperature of the cathode or anode gas introduced into the second temperature regulator 50 is so close to a preset temperature that the gas can be heated up to the preset temperature by heat exchange with an inner atmosphere in the thermostatic chamber 60 during passing through the second temperature regulator 50.

By contraries, if and when flow rate of cathode or anode gas is in a small rate and difference between the preset temperature and a temperature of the cathode or anode gas introduced into the second temperature regulator 50 is relatively large, the controller 70 applies current to the heating elements 35 so as to heat up the gas to the preset temperature. If and when flow rate of cathode or anode gas is controlled to a large rate equivalent to 200 L/m, the cathode or anode gas flows in the second temperature regulator 50 at a high speed, resulting in an insufficient heat exchange with an inner atmosphere in the thermostatic chamber 60. Thus, the controller 70 applies current to the heating elements 35, so as to heat the cathode or anode gas flowing in the second temperature regulator 50. At this time, output of each of the heating elements 35 incorporated in the second temperature regulator 50 is controlled by a feedback system based on temperature detected by the surface temperature sensor 35*e* attached to the downstream in a direction of gas flow of the heat receiving tube 53 and temperature of gas effluent from the second temperature regulator 50 detected by the effluent gas temperature sensor 37.

Upon starting up the heating elements 35, the whole outer surfaces of the heat receiving tubes 53 are heated, whereas cathode or anode gas having flown into the second temperature regulator 50 is divided into each of the tubes 53 after heat exchange at the header 51.

The cathode or anode gas flow is made turbulent after entry into each of the tubes 53 by means of the mixer 36 located within the tube 53. As described above, being in close contact with the inner surface of the tube 53, the mixer 36 has reached a high temperature by heat transferred from the tube 53. Further, since the tube 53 has the heating elements 35 mounted thereon and encircling its outer periphery, the inner atmosphere of the tube 53 is substantially evenly heated in any part thereof. Still further, as described above, since the cathode or anode gas is divided into each of the tubes 53, the gas is evenly heated regardless of flow rate. Therefore, the cathode or anode gas is smoothly and efficiently heated in the tubes 53. The cathode or anode gas having passed though the tubes 53 is further heat exchanged after flowing into the header 52.

The cathode or anode gas is supplied to the fuel cell 10 after the gas is regulated into a predetermined temperature by means of the second temperature regulator 50.

When the evaluation equipment 1 operates in the low-temperature test mode, the controller 70 starts up the cooler 27 to cool cathode or anode gas to a predetermined temperature and then supplies the cooled gas to the fuel cell 10. More specifically, in operating the evaluation equipment 1 in the low-temperature test mode, if humidified cathode or anode gas were supplied to the cooler 27, a problem such as damage of the cooler 27 might occur. In the low-temperature test mode of the evaluation equipment 1, therefore, the controller 70 brings the heater 21 and the humidifier 23 to a halt and makes the flow rate adjuster 22 at the second (high-humidity) passageway 15 to be closed. Then, the flow rate adjuster 20 at the first passageway 13 is controlled according to flow rate of the cathode or anode gas to be supplied to the fuel cell 10. Thereby, the cathode or anode gas at a predetermined flow rate is supplied from the cathode gas supply source 28 or the anode gas supply source 29 through the first passageway 13 to the cathode gas passageway 11 or the anode gas passageway 12, respectively.

Meanwhile, the passageway switches 25 and 26 in each of the cathode and anode gas passageways 11 and 12 are regulated so as to be made open into the cooling passageway 16. Thereby, each of the cathode and anode gas having flown into the cathode or anode gas passageway 11 or 12 flows in the cooling passageway 16 to be cooled by the cooler 27 to a predetermined temperature. Each of the cathode and anode gas cooled by the cooler 27 is introduced into the second temperature regulator 50 disposed in the thermostatic chamber 60 of the thermostat 5 located adjacent to the cooler 27. Each of the cathode and anode gas introduced into the second temperature regulator 50 is finely regulated to a predetermined temperature by heat exchange in the thermostatic chamber 60, whereupon the gas is supplied to the fuel cell 10.

As described above, the evaluation equipment 1 evaluates the performance of the fuel cell 10 installed in the thermostatic chamber 60, so as to precisely regulate an installation condition of the fuel cell 10.

As described above, the evaluation equipment 1 has such a structure that cathode gas or anode gas passes through the second temperature regulator 50 disposed in the thermostatic chamber 60 before being supplied to the fuel cell 10. Thereby, if and when the gas to be supplied to the fuel cell 10 in a large rate and regulated in temperature by the regulator 3 is introduced into the second temperature regulator 50 maintaining its temperature with little change, the gas is supplied to the fuel cell 10 with finely regulated by heat exchange at the second temperature regulator 50. By contraries, according to the evaluation equipment 1, even if and when the gas supplied to the fuel cell 10 is in a small rate and slow in flowing, the gas is supplied to the fuel cell 10 after being regulated to a test temperature of the fuel cell 10, that is, a temperature within the thermostatic chamber 60, by heat exchange at the second temperature regulator 50. According to the evaluation equipment 1, even if a temperature of gas is below a predetermined temperature when introduced into the second temperature regulator 50, the gas is supplied to the fuel cell 10 with regulated into a predetermined temperature by operations of the heating elements 35 mounted to the heat receiving tubes 53. Consequently, according to the evaluation equipment 1, gas at a suitable temperature for an evaluation of the fuel cell 10 is supplied to the fuel cell 10, regardless of the flow rate of gas supply to the fuel cell 10.

Further, the evaluation equipment 1 in the present embodiment has the cooler 27 positioned on each of the cathode and anode gas passageways 11 and 12 of the gas passageway 2, so as to evaluate an operation of the fuel cell 10 placed under low temperature condition such as in cold climates. Still further, the evaluation equipment 1 has the cooler 27 positioned just before thermostat 5, so as to supply gas cooled to a predetermined temperature to the fuel cell 10 with certainty.

Building in an interlock mechanism, the evaluation equipment 1 operates the passageway switches 25 and 26 so as to prevent gas flowing towards the cooler 27 in a state capable of cooling to a lower temperature than dew point of gas flowing in each of the cathode and anode gas passageways 11 and 12 of the gas passageway 2. Therefore, the evaluation equipment 1 has no unexpected failure involving freezing of water contained in gas.

As described above, since the fluid heater 30 and the second temperature regulator 50 are formed by positioning the heating elements 35 on the outer periphery of the heat receiving tubes 33 and 53 of a cylindrical shape respectively, gas flowing therein is uniformly heated, and even if the rate of gas supply or a heating target temperature is altered, gas flowing in the tubes 33 and 53 is smoothly and precisely heated up to the heating target temperature.

Further, in the fluid heater 30 and the second temperature regulator 50, the heating elements 35 are positioned at the outer periphery of the tubes 33 and 53, so that gas flowing therein has no direct contact with the heating elements 35. Therefore, the fluid heater 30 and the second temperature regulator 50 also heat well explosive fluid such as gas mainly consisting of hydrogen or flammable fluid.

As described above, since the heating elements 35 each include a heating layer 35*b* formed by printing and heat-curing (baking) a paste such as a silver palladium paste on the surface of the insulating layer 35*a*, the insulating layer 35*a* has almost no interspace between the heating layer 35*b*, causing little heat transfer resistance between the insulating layer 35*a* and the heating layer 35*b*.

The fluid heater 30 and the second temperature regulator 50 have such a structure as heating gas divided into each of the heat receiving tubes 33 and 53. Further, the mixer 36 is built in each of the tubes 33 and 53, thereby making gas introduced into the tubes 33 and 53 to flow turbulently. Further, since the mixer 36 is in close contact with the inner surface of each of the heat receiving tubes 33 and 53 at its outside edge, rising in temperature of the tubes 33 and 53 smoothly transfers heat to the mixer 36. Thereby, the fluid heater 30 and the second temperature 50 smoothly and evenly heat gas regardless of flow rate of gas.

As described above, the heating elements 35 each operate upon electric supply from the DC power source 38. Thus, electric current supplied to the heating elements 35 is continuously controlled regardless of output required for the heating elements 35. More specifically, electric current is continuously supplied, not intermittently as in the case of controlling output by a method such as a duty ratio control using relay or solid state relay (SSR) like a conventional control of a heater. Consequently, the fluid heater 30 and the second temperature regulator 50 precisely regulate gas temperature regardless of flow rate of gas or of fluctuation of flow rate.

Further, the heating elements 35 each include the heating layer 35*b* made of a material such as a silvery paste whose resistance widely fluctuates depending on a temperature condition and a plurality of resistive parts 35*f* mainly constituting the heating layer 35*b* mutually connected in parallel. Still further, the heating elements 35 have such a structure that the resistive parts 35*f* are arranged at substantially equal intervals in a circumferential direction of each of the heat receiving tubes 33 and 53. Thus, as each of the resistive parts 35*f* sensitively fluctuates in response to its temperature, the heating elements 35 substantially evenly heat the tubes 33 and 53 and gas flowing in the tubes 33 and 53.

The fluid heater 30 and the second temperature regulator 50 each include the two heating elements 35 and 35 arranged in two places on each of the heat receiving tubes 33 and 53, one at the upstream and the other at the downstream in a direction of gas flow in the tubes 33 and 53, the heating elements 35 having different electric resistances. More specifically, the upstream heating element 35 arranged at the upstream in a direction of gas flow on each of the tubes 33 and 53 has a higher electric density of the resistive parts 35*f* than that of the downstream heating element 35, so as to regulate the electric power density supplied to each of the heating elements 35 and 35. Consequently, the evaluation equipment 1 precisely controls temperature of gas supplied to an article to be evaluated such as the fuel cell 10 even with wide alteration of flow rate of gas depending on a test condition.

The heating elements 35 each are formed by laminating the insulating layer 35*a*, the heating layer 35*b*, and the covering layer 35*c* on the outer surface of the heat receiving tubes 33 and 53 of a tubular shape, any layer being laminated so as to assume a circular arc on cross section. Consequently, the heating elements 35 have no stress concentrated in any layer caused by sharp temperature fluctuations or usage over long period of time, so as to hardly have a failure such as a crack on any layer or a malfunction resulting from delamination or the like.

As described above, the second temperature regulator 50 has the fins 56 attached to the headers 51 and 52 so as to reinforce the headers 51 and 52 and improve heat exchange efficiency. Consequently, according to the structure described above, gas introduced into the headers 51 and 52 are precisely regulated into an atmospheric temperature within the thermostatic chamber 60 regulated into a test temperature of the fuel cell 10.

Further, the second temperature regulator 50 have the fins 56 secured to outside of the headers 51 and 52, so as to be readily manufactured and make the inner surfaces of the headers 51 and 52 flat and smooth. Thus, the second temperature regulator 50 maintains the inner surfaces of the headers 51 and 52 clean and prevents any foreign body from adhering. Consequently, an operation of the evaluation equipment 1 over a long period of time hardly causes such a failure as foreign bodies getting into gas supplied to the fuel cell 10.

The evaluation equipment 1 in the above-mentioned embodiment has such a structure that cathode gas or anode gas is respectively supplied from the cathode gas supply source 28 or the anode gas supply source 29, but the present invention is not limited thereto, and may have such a structure as being separately provided with a mixer adapted to mix gas such as hydrogen or oxygen that is used as an active material of the fuel cell 10 with inactive gas such as nitrogen gas or argon gas at a predetermined mixing ratio, or supplying a gas mixture whose mixing ratio is regulated in advance.

The evaluation equipment 1 in the present embodiment is suitably applicable for an evaluation of a polymer electrolyte fuel cell (PEFC), but the present invention is not limited thereto, and may be suitably applicable for evaluations of so-called low temperature fuel cells such as alkaline fuel cells (AFC) and phosphoric acid fuel cells (PAFC) by controlling means such as the heater 21, the humidifier 23, or the cooler 27 so as to perform heating, humidifying, cooling, or the like of gas according to evaluation conditions.

The above-mentioned embodiment exemplifies such a structure that the cooler 27 is located adjacent to the thermostat 5 so as to prevent making a difference between a predetermined temperature and a temperature of gas supply to the fuel cell 10 resulting from temperature rising of gas cooled by the cooler 27. However, if substantially no difference as described above may be made, it is possible to locate the cooler 27 at the upstream of the humidifier 23, for example. According to this structure, there is no need to build in the interlock mechanism described above, so as to more simplify components of the gas passageway 2.

As described above, the second temperature regulator 50 has the fins 56 radially attached to the outside of the header bodies 51*a* and 52*a*, but the present invention is not limited thereto, and for example, may have the fins 56 attached so as to extend tangential to the header bodies 51*a* and 52*a*. Further, the fins 56 may protrude into the inner side of the headers 51*a* and 52*a* though this structure is unrecommended taking in account simplicity of manufacturing or clean maintenance of the inner surfaces of the header bodies 51*a* and 52*a*. Still further, in the second temperature regulator 50, a mounting position or a mounting posture thereof may be properly modified in accordance with the intended use, for example, without the fins 56 or with the fins 56 attached to both the inner and outer side of the header bodies 51*a* and 52*a*.

The second temperature regulator 50 and the fluid heater 30 have the heating elements 35 positioned on the surfaces of the heat receiving tubes 53 and 33 to heat gas flowing in the inner cavities of the tubes 53 and 33, but the present invention is not limited thereto, and may have the heating elements 35 positioned within the tubes 53 and 33 if necessary.

The second temperature regulator 50 and the fluid heater 30 have a plurality of the heat receiving tubes 53 and 33, but the present invention is not limited thereto, and may have only one heat receiving tube for one regulator 50 or heater 30. Further, the second temperature regulator 50 and the fluid heater 30 have the mixer 36 that is made by winding a metal strip or belt in a spiral configuration arranged within each of the tubes 53 and 33, but may not have the mixer 36 or may have a member whose configuration or material is different from that of the mixer 36.

The above-mentioned embodiment illustrates a structure having the second temperature regulator 50 within the thermostatic chamber 60, but the present invention is not limited thereto, and may have a structure without the second temperature regulator 50, or may have a structure having within the thermostatic chamber 60 the fluid heater 30, which has substantially the same structure as the second temperature regulator 50, instead of the regulator 50.

The heating elements 35 described above each employ a vitreous material as the insulating layer 35*a* and the covering layer 35*c*, but the present invention is not limited thereto, and may employ a material such as a sintered ceramics. If and when a sintered ceramics is employed for the insulating layer 35*a*, it is preferable to employ a sintered ceramics having high heat conductivity such as one mainly consisting of at least one material selected from alumina, aluminum nitride, and silicon nitride, taking into account heat transfer efficiency from the heating layer 35*b* to the heat receiving tube 53 or 33. Further, the heating element 35 preferably employs materials to form the insulating layer 35*a*, the heating layer 35*b*, and the covering layer 35 having similar coefficient of thermal expansion so as to protect the layers from a failure such as cracks resulting from aged deterioration.

The heating element 35, as shown in FIGS. 4B and 4C, is formed by a plurality of the resistive parts 35*f* linearly arranged in a longitudinal direction on each of the heat receiving tubes 53 and 33, but the present invention is not limited thereto, and may be formed by the resistive parts 35*f* zigzagged or corrugated. Further, the resistive parts 35*f* may be arranged so as to surround the outer periphery of the tubes 53 and 33 with the resistive parts 35*f* or to be helically wound around the tubes 53 and 33.

The heating element 35 has such a structure that the linear resistive parts 35*f* are arranged at substantially regular intervals at the outer periphery of each of the heat receiving tubes 53 and 33, but the present invention is not limited thereto, and may have such a structure that the adjacent resistive parts 35*f* are differently spaced out each other.

As described above, the heating elements 35 and 35 mounted in two places on each of the heat receiving tubes 53 and 33 each have independently the insulating layer 35*a*, heating layer 35*b*, and the covering layer 35*c*, but the present invention is not limited thereto, and the heating elements 35 and 35 mounted in two places may share the insulating layer 35*a* or the covering layer 35*c* with each other.

As described above, the fluid heater 30 and the second temperature regulator 50 have the heating elements 35 and 35 mounted in two places in a longitudinal direction of each of the heat receiving tubes 33 and 53, but may have the heating element 35 mounted in one place on each of the tubes 33 and 53, or may have the heating elements 35 mounted in more than two places.

Further, in the above-mentioned embodiment, the two heating elements 35 and 35 mounted on each of the heat receiving tubes 33 and 53 are independently connected to the corresponding DC power sources 38 and 38, thereby precisely heating gas flowing in the tubes 33 and 53. Herein, the above-mentioned embodiment illustrates such a structure that each of the heating elements 35 and 35 is connected to the corresponding DC power sources 38 and 38, but the present invention is not limited thereto, and may have such a structure, for example, that the two heating elements 35 and 35 are connected in series or in parallel to each other so as to form one electric circuit. In this structure, a structure of an electric circuit of the fluid heater 30 or the second temperature regulator 50 is simplified.

The above-mentioned embodiment regulates arrangement density of the resistive parts 35*f* at the heating element 35 (upstream heating element) positioned at the upstream and at the heating element 35 (downstream heating element) positioned at the downstream both in a direction of gas flow in each of the heat receiving tubes 33 and 53, thereby regulating density of electric current supplied to both of the heating elements 35 and 35. However the present invention is not limited thereto, and may have such a structure as having the same arrangement density of the resistive parts 35*f* at the upstream heating element 35 and at the downstream heating element 35 to regulate output of each of the heating elements 35 and 35 only by regulating output of the DC power source 38 connected to each of the heating elements 35 and 35.

In the above-mentioned embodiment, the evaluation equipment 1 for evaluating the fuel cell 10 is illustrated as an example of equipments provided with a fluid heater such as the fluid heater 30 or the second temperature regulator 50 of an preferred embodiment of the present invention, but the present invention is not limited thereto. Specifically, the fluid heater 30 or the second temperature regulator 50 is employed as a heater for heating fluid such as gas or liquid supplied to an article to be evaluated in evaluation equipments for studies or developments in biotechnology field or of a drug or fluid itself to be evaluated. Further the evaluation equipment 1 supplies gas regulated at a predetermined temperature or humidity to the fuel cell 10 to perform an evaluation, but the present invention is not limited thereto, and may supply fluid such as gas or liquid regulated in temperature to a predetermined article to be evaluated to perform a predetermined evaluation, or may use fluid itself as an article to be evaluated. More specifically, it is possible to employ the fluid heater 30 or the second temperature regulator 50 as culture apparatus, which evaluates simulating environment factors within the living body, including a carbon dioxide culture apparatus, an anaerobic culture apparatus, or an incubator, or as evaluation equipments for a stability test or a preservation test for checking a quality preservation property of products such as a drug, a chemical agent, or a cosmetic.

Further, in the evaluation equipment 1 of the present embodiment, the gas passageway 2 is a so-called one-pass passageway, in which gas flows from the cathode or anode gas supply source 28 or 29 only toward the fuel cell 10, but the present invention is not limited thereto, and may have a circuit-system passageway in which fluid such as gas or liquid circulates.

The evaluation equipment 1 described above is provided with not only the fluid heater 30 and the second temperature regulator 50 for heating fluid such as gas but also other means such as the humidity regulator 7, the thermostat 5 adapted to accommodate the fuel cell 10 to be evaluated, or the cooler 27, but the present invention is not limited thereto, and may not have a means such as the thermostat 5, the humidity regulator 7, or the cooler 27.

The invention claimed is:

1. A fluid heater comprising:

a header; and a heat receiving tube having an outer periphery, the header and the heat receiving tube mutually communicating so that fluid flows therethrough, wherein the heat receiving tube has a heating element positioned on the outer periphery of the tube, wherein the heating element comprises a heating layer adapted to generate heat by electric supply, an insulating layer insulating the heating layer and the heat receiving tube, and a covering layer covering the heating layer, wherein the heat receiving tube has a plurality of the heating elements or the heating layers mounted on the tube, and wherein the heating elements or the heating layers have different electrical resistances depending on positions where the elements or the layers are mounted.

2. The fluid heater as defined in claim 1, wherein at least one of the heating layers is printed on the insulating layer.

3. The fluid heater as defined in claim 1, wherein at least one of the heating layers is composed of a plurality of heating parts mutually connected in parallel.

4. The fluid heater as defined in claim 1, wherein the heating elements or the heating layers each has electric resistance that varies with temperature.

5. The fluid heater as defined in claim 1, wherein the heating elements or the heating layers are mounted on the tube and arranged in a direction of gas flow.

6. The fluid heater as defined in claim 1, wherein the outer periphery of the heat receiving tube is evenly surrounded by at least one of the heating elements.

7. The fluid heater as defined in claim 1, wherein the heat receiving tube accommodates a mixer so as to improve heat exchange efficiency of a fluid.

8. The fluid heater as defined in claim 1, wherein the heat receiving tube has an inner surface, and wherein the heat receiving tube accommodates a mixer, the mixer being located in immediate proximity to the inner surface of the heat receiving tube.

9. The fluid heater as defined in claim 1, wherein the header has a fin attached thereto.

10. The fluid heater as defined in claim 1, wherein the header has a header body adapted to introduce gas thereinto, the header body having a fin attached to its outer periphery.

11. The fluid heater as defined in claim 1, wherein at least one of the heating elements is adapted to be activated by a direct-current power source.

12. The fluid heater as defined in claim 1, wherein the heating elements are mounted and arranged on a plurality of positions on the heat receiving tube in a direction of fluid flow therein.

13. The fluid heater as defined in claim 1 further comprising a plurality of the heat receiving tubes, each of which has one of the heating elements, whose output is individually controllable.

14. A fluid heater comprising:

a header, and a plurality of heat receiving tubes, the header and each of the heat receiving tubes mutually communicating so that fluid flows therethrough, and being adapted to divide gas flowing through the header into the heat receiving tubes, wherein at least one of the heat receiving tubes has a heating element positioned on the outer periphery of the at least one tube and is adapted to generate heat by electric supply, wherein the heating element has different electric resistances depending on positions where the heating element is mounted on the at least one tube.

15. The fluid heater as defined in claim 14, wherein the heating element is composed of a plurality of heating parts adapted to generate heat by electric supply and mutually connected in parallel.

16. The fluid heater as defined in claim 14, wherein the at least one heat receiving tube has a plurality of the heating elements, mounted on the at least one heat receiving tube and arranged in a direction of gas flow, and wherein the heating elements have different electric resistances depending on positions where the elements are mounted on the at least one heat receiving tube.

17. The fluid heater as defined in claim 14, wherein the outer periphery of the at least one heat receiving tube is evenly surrounded by the heating element.

18. The fluid heater as defined in claim 14, wherein the at least one heat receiving tube accommodates a mixer so as to improve heat exchange efficiency of a fluid.

19. The fluid heater as defined in claim 14, wherein the at least one heat receiving tube has an inner surface, and wherein the at least one heat receiving tube accommodates a mixer, the mixer being located in immediate proximity to the inner surface of the at least one heat receiving tube.

20. The fluid heater as defined in claim 14, wherein the header has a fin attached thereto.

21. The fluid heater as defined in claim 14, wherein the header has a header body adapted to introduce gas thereinto, the header body having a fin attached to its outer periphery.

22. The fluid heater as defined in claim 14, wherein the heating element is adapted to be activated by a direct-current power source.

23. The fluid heater as defined in claim 14, wherein at least one of the heat receiving tubes has a plurality of heating elements that are mounted and arranged on a plurality of positions on the at least one heat receiving tube in a direction of fluid flow therein.

24. The fluid heater as defined in claim 14, wherein the at least one heat receiving tube has a heating element, whose output is individually controllable.

* * * * *